United States Patent [19]

Day et al.

[11] Patent Number: 5,042,263

[45] Date of Patent: Aug. 27, 1991

[54] ICE MAKING MACHINE WITH FREEZE AND HARVEST CONTROL

[75] Inventors: Donald D. Day, Chesterfield; Delbert J. Potter, Saint Peters, both of Mo.

[73] Assignee: SerVend International, Inc., Sellersburg, Ind.

[21] Appl. No.: 566,503

[22] Filed: Aug. 13, 1990

[51] Int. Cl.[5] ..... F25C 1/12

[52] U.S. Cl. ..... 62/74; 62/138

[58] Field of Search ..... 62/138, 74, 347

[56] References Cited

U.S. PATENT DOCUMENTS

| | | | |
|---|---|---|---|
| 2,598,429 | 5/1952 | Pownall | 62/352 |
| 3,043,117 | 7/1962 | Bollefer | 62/347 |
| 3,144,755 | 8/1964 | Kattis | 62/347 |
| 3,430,452 | 3/1969 | Dedricks et al. | 62/347 |
| 3,977,851 | 8/1976 | Toya | 62/135 |
| 4,248,055 | 2/1981 | Day, III et al. | 62/196 C |
| 4,341,087 | 7/1982 | Van Steenburgh, Jr. | 62/233 |
| 4,471,624 | 9/1984 | Nelson | 62/1 |
| 4,727,729 | 3/1988 | Toya | 62/347 |
| 4,733,539 | 3/1988 | Josten et al. | 62/73 |
| 4,774,814 | 10/1988 | Yingst et al. | 62/126 |

*Primary Examiner*—William E. Tapolcai

*Attorney, Agent, or Firm*—James Creighton Wray

[57] ABSTRACT

An ice maker including freeze and harvest controls is disclosed. The evaporator includes a unitary evaporator and ice mold. A compressor and condenser cool the evaporator to freeze ice on the mold in a normal refrigeration cycle and the mold is defrosted by hot gas to harvest ice from the ice mold. The temperature of the ice mold and the liquid line temperature of the condenser are sensed to control the length of time of the ice forming cycle.

4 Claims, 12 Drawing Sheets

(HOT AMBIENT)
(NORMAL AMBIENT)
(COLD AMBIENT)
714
704
724
716
706
726
712
718
702
728
722
EVAPORATOR (HOT AMBIENT)
EVAPORATOR (NORMAL AMBIENT)
EVAPORATOR (COLD AMBIENT)
EVAP PROBE
ICE FORMING CYCLE
TIME
CONDENSER PROBE
°F
100
80
60
40
32
20
10
0

ICE MAKING MACHINE WITH FREEZE AND HARVEST CONTROL

BACKGROUND OF THE INVENTION

1. Field of the Invention

The present invention pertains generally to ice making apparatus using a gravity water flow and recirculation system, and more particularly to an ice maker having improved controls for freeze and harvest cycles.

2. Description of the Prior Art

Ice cube makers employing gridded freeze plates forming lattice-type cube molds and having gravity water flow and ice harvest are well known and in extensive use. Such machines have received wide acceptance and are particularly desirable for commercial installations such as restaurants, bars, motels and various beverage retailers having a high and continuous demand for fresh ice.

A leading example of this type of ice cube maker is made by Manitowoc Company, Inc. and disclosed in its Dedricks et al. U.S. Pat. No. 3,430,452, and control improvements of Manitowoc are disclosed in its Schulze-Berge U.S. Pat. Nos. 4,480,441 and 4,550,572.

Another example of lattice-type cube makers is disclosed in Van Steenburgh U.S. Pat. Nos. 4,341,087 and 4,366,679 assigned to Mile High Equipment Company.

Other patents having ice cube makers of this general type include Kattis U.S. Pat. No. 3,144,755; Johnson U.S. Pat. No. 3,913,349; Nelson U.S. Pat. No. 4,471,624 assigned to King-Seeley Thermos Co.; Josten et al. U.S. Pat. No. 4,733,539 assigned to Schneider Metal Mfg. Co. and Toya U.S. Pat. No. 4,727,729 assigned to Hoshizaki Electric Co. (Japan).

There have been various problems associated with commercial ice making machines, particularly in the production of a substantially consistent and uniform cube size in various types of environmental settings. Cyclical ice makers that initiate a harvest cycle by sensing evaporator refrigerant pressure or temperature have a common problem in determining ice size due to the variation in refrigerating capacity in response to changes in ambient air temperature as well as from poor maintenance, such as failure to keep air-cooled condensers clean. The tendency for the evaporator control is to produce premature or undersized ice cubes when condensing capacity is greatest, such as at low ambient air conditions. The reverse is true when condensing capacity is reduced by reason of high ambient air temperatures or fouled condensers. In this case, ice size becomes unacceptably large, and in some oases the ice may not harvest at all if the control set point cannot be reached due to this lowered refrigerating capacity. Thus, where an ice maker is installed in an outdoor location, such as a motel or service station, and subjected to wide seasonal temperature changes, the cube size can vary appreciably from a thin, undersized cube in the winter to an oversized cube in the summer. Furthermore, the time cycle of making such cubes is directly affected by such ambient changes.

It has been proposed that systems can compensate for this problem by using a combination of evaporator pressure (or temperature) and time in controlling the cyclical defrosting cycle. The evaporator pressure (or temperature) sensing point is raised to trip earlier in the cycle and initiate a fixed time period through a mechanical or electronic timer that starts the harvest cycle. Such a system is, at best, an approximation and still allows a wide variation in ice cube size, with accompanying loss of reliability over the ambient air temperature range and operating conditions to which many ice makers are exposed.

SUMMARY OF THE INVENTION

According to the present invention, an ice making machine utilizes an evaporator formed integral with the base freeze plate of a lattice mold, and has a primary freeze cycle control sensor for sensing evaporator temperatures at a location spaced away from such base plate. The invention is further embodied in a secondary freeze cycle control sensor for monitoring condensing capacity, and also employs improvements in water pump operation and harvest control switching.

The principal object of the present invention is to provide an improved ice making machine that produces ice cubes of substantially uniform size under seasonally varying ambient conditions.

Another object is to provide an ice maker having an improved evaporator configuration intimately associated with the freeze base plate of a lattice mold, an improved sensing and regulating circuit for controlling the ice freeze cycle, an improved harvest control for controlling the next freeze cycle, and an improved water pump system.

It is an object to provide a reliable, economical and efficient ice making machine for rapidly producing clear, fresh and uniform ice cubes.

These and still other objects and advantages will become more apparent hereinafter.

BRIEF DESCRIPTION OF THE DRAWINGS

In the drawings which illustrate embodiments of the invention.

DESCRIPTION OF THE PREFERRED EMBODIMENTS

Figure 1:
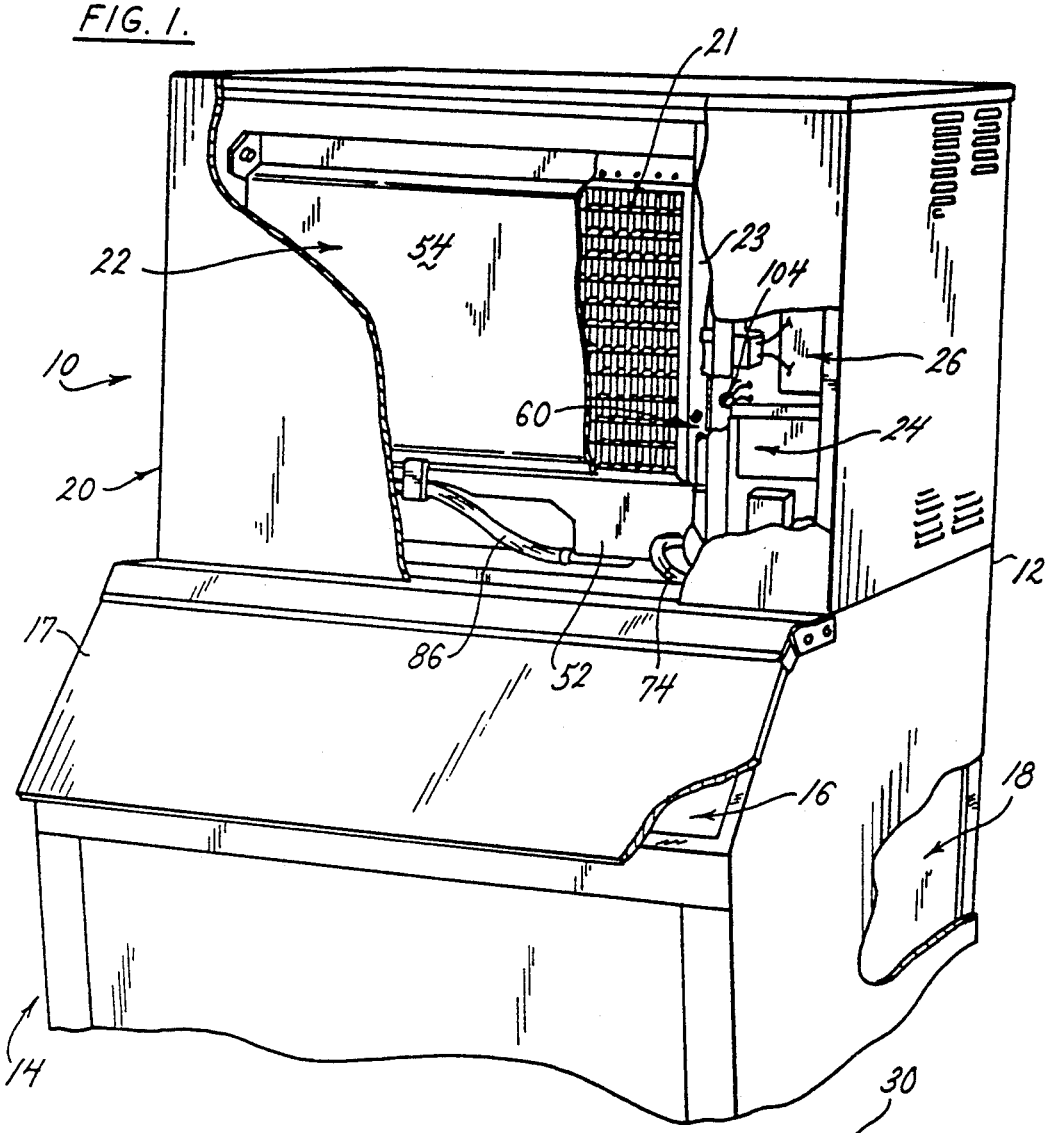
FIG. 1 is a perspective view, partly broken away, of an ice making machine embodying the present invention.
Figure 1A:
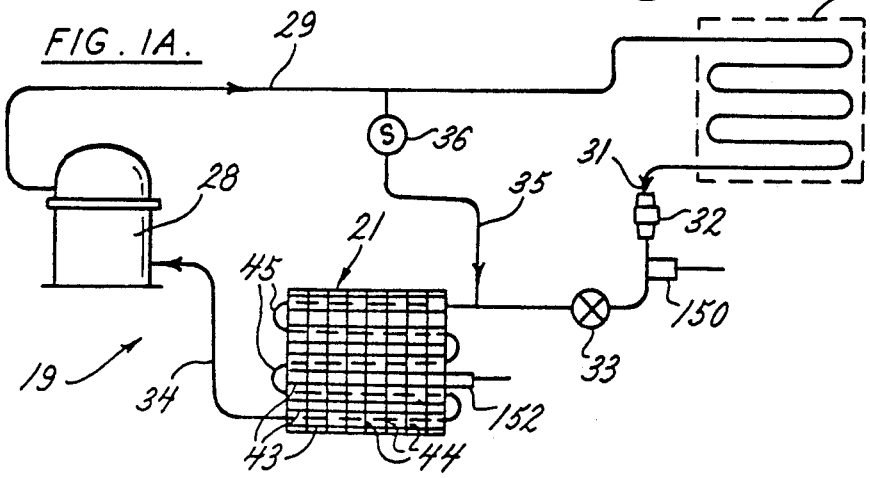
FIG. 1A is a diagrammatic illustration of the refrigeration circuit for the ice maker.

Referring to FIG. 1 of the drawings, a commercial type ice making machine 10 of the present invention is housed in an insulated cabinet 12 having a lower housing or cabinet section 14 that includes a front ice receiving and storing compartment 16 accessible through door 17 and a rear refrigeration compartment 18 housing the compressor-condenser units of a closed refrigeration circuit 19 diagrammaticlly shown in FIG. 1A to be described. The cabinet 12 also has an upper housing or cabinet section 20 that includes a main evaporator unit 21 in the ice freezing chamber or compartment 22, which is separated by an insulated vertical panel 23 from a laterally disposed lower water pump compartment 24 and upper control circuit compartment 26. The various compartments of the ice maker cabinet 12 are closed by suitable fixed and removable insulated panels to provide temperature integrity and compartmental access, as will be understood by those in the art.

Referring now to FIG. 1A, the closed refrigeration system 19 housed in compartment 18 includes a refrigeration compressor 28 and an air or water cooled condenser 30, the high pressure discharge side of the compressor being connected by discharhge line 29 to the condenser 30. Saturated liquid refrigerant flows from the condenser 30 through liquid line 31 having a filter/drier unit 32 therein, and is connected to a typical thermostatic expansion valve 33 which meters refrigerant into the inlet side of the evaporator unit 21 in the freeze compartment 22. The outlet of the evaporator is connected by suction line 34 to the suction side of the compressor 28. The normal refrigeration cycle is typical—the compressor 28 supplies high pressure hot refrigerant gas to the condenser 30, where it is cooled to its saturation temperature and liquified refrigerant flows to the evaporator 21 through expansion valve 33. The expanding vaporization of liquid refrigerant in the evaporator removes heat from the water on the evaporator face plate (as will be described) thereby forming the ice cubes in the lattice molds thereon, and the gaseous refrigerant is returned to the compressor suction side to complete the refrigeration and freeze cycle. The system 19 also includes a hot gas by-pass line 35 connected between the discharge line 29 and the evaporator inlet side downstream of expansion valve 33, and being controlled by solenoid valve 36 to initiate an ice harvest cycle as will be described.

Figure 1B:
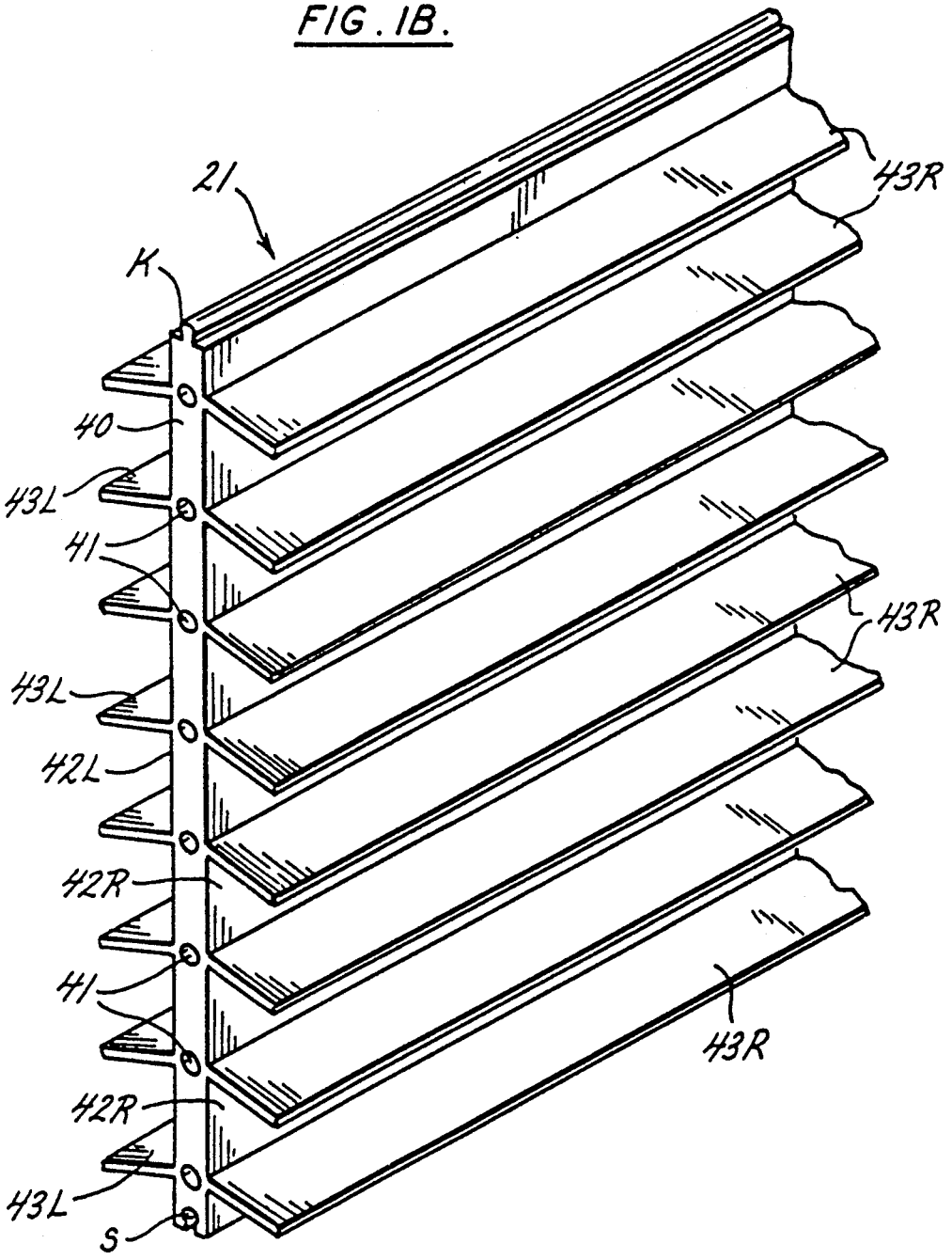
FIG. 1B is a diagrammatic view of a preferred embodiment of evaporator extrusion for use in the ice maker.

One feature of the present invention is embodied in the evaporator unit 21. Traditionally, in the past, the ice forming molds have included a base freeze plate on which serpentine copper coils of an evaporator have been attached in line contact to the rear face and brazed or soldered to provide as good heat exchange properties as possible. According to the present invention as illustrated in FIG. 1B, the evaporator unit 21 preferably comprises an extruded, high density, non-porous evaporator body formed of aluminum or the like, and including a base wall 40 containing internal bores 41 for forming the refrigeration circuit and integral external base freeze plate surfaces 42 and integral horizontally projecting fins 43. The external and fin surfaces 42,43 are food-grade cleanable with a durable surface finish, with or without anodizing. Vertical fins 44 of the same evaporator material are connected across the horizontal fins 43 to define the cross gridded or lattice molds 46, and end return bends 45 are connected to the body base wall 40 to connect the bores 41 and complete the integral evaporator coil circuit.

In the FIG. 1B embodiment, one feature of the extruded evaporator improvement is that it can provide for double outward-facing lattice mold surfacing of the coil 21 thereby doubling the ice production capability of the ice maker 10 in a small space at a minimum additional expense. Thus the evaporator 21 has integral external base freeze plate surfaces 42L and 42R in outward facing or opposed relation; and integral horizontal fins 43L and 43R project opposite to each other. In this embodiment the fins 43L and 43R angle downwardly for ice harvesting purposes, and the cross-sectional area of each fin 43L,43R is uniform from the base wall 42L,42R to the outer fin tip.

Figure 2:
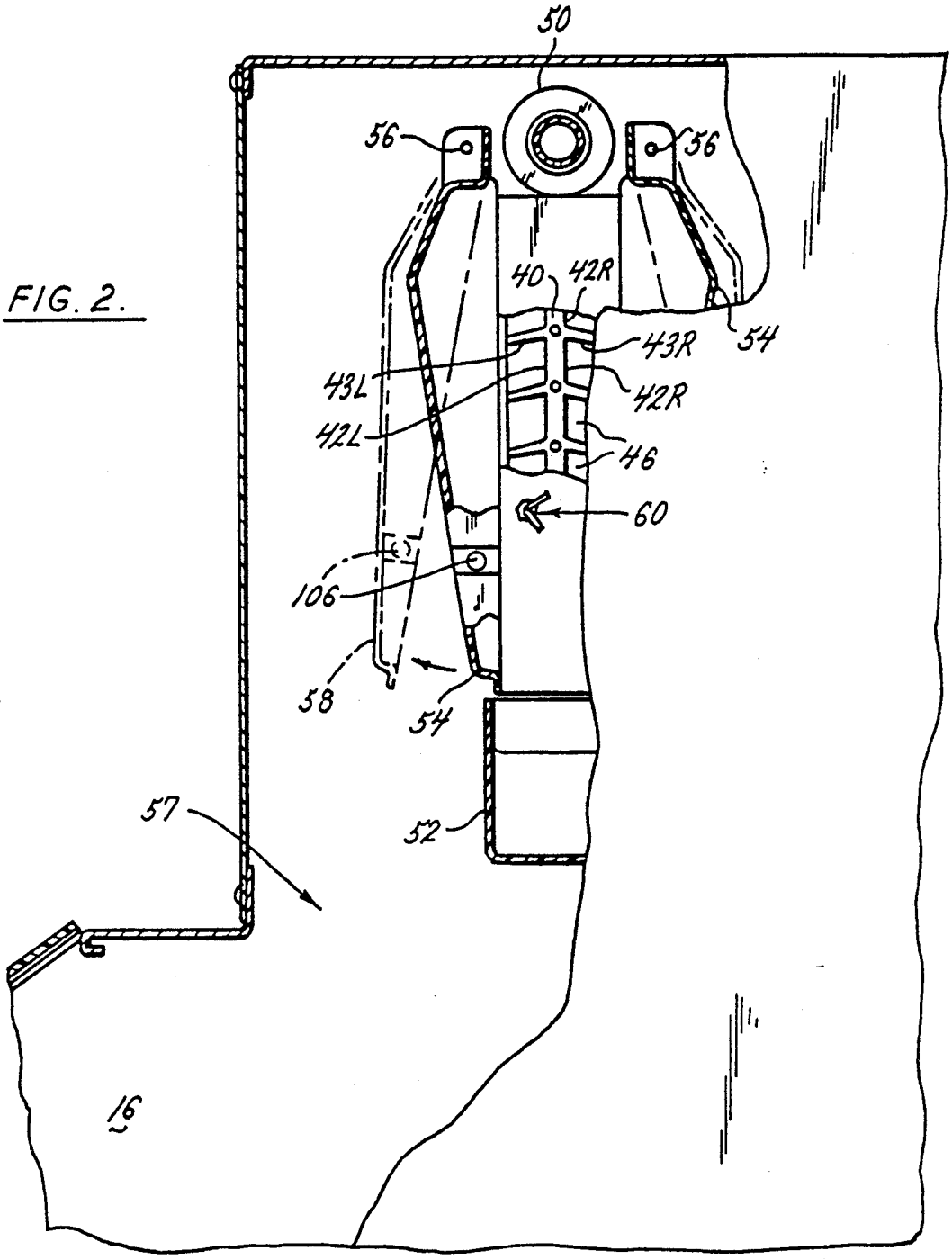
FIG. 2 is a side elevational view, partly broken away, of the ice making compartment of the ice maker showing one embodiment of an extruded evaporator and showing in phantom a harvesting condition.

As shown in FIG. 2, in another embodiment the horizontal fins 43L,43R are tapered in a decreasing cross-sectional area in the direction from the base wall 42 to the outer tip of the fin. This provides a better heat transfer throughout the fin surfaces of the cube molds 46, and this fin tapering also provides an ice mold pocket with a smaller interior dimension than the opening to provide easier harvest. In either a single-sided or double-sided mold configuration, fins 43 may be tapered or untapered.

As illustrated in FIG. 2, the fins 43L and 43R are tapered. In this configuration, gravity water flow is provided to each side of the evaporator 21 so that the ice forming molds 46 on each side of the evaporator are simultaneously forming ice cubes during each ice freeze cycle. The header or distributor tube 50 supplies water by gravity flow to the ice forming molds on either side of the evaporator unit and is positioned above the evaporator unit as best shown in FIG. 2. Water which flows down either side of the evaporator unit adheres to the ice molds 46 due to the surface tension of the water. Water which does not freeze is collected in water pan 52 and recirculated to the distributor tube 50 for application again to the ice forming molds 46.

As shown in FIG. 1B, it is contemplated that the top edge of evaporator unit 21 may be provided with a key K for engaging a slot S in the bottom edge. In this way, extruded evaporator sections may be stacked vertically, one above the other.

As shown in FIG. 2, for a two-sided mold it is preferable that both sides of the evaporator are covered with a gravity closing door or curtain 54 for detecting falling ice. After completion of the ice forming cycle, the evaporator unit 21 is defrosted by hot gas defrost until the ice formed in the molds 46 falls away from the evaporator thereby permitting the next ice freeze cycle to begin. Curtain 54 is positioned adjacent the ice forming molds 46 so that falling ice causes the curtain 54 to move away from the molds 46. In particular, the top of the curtain 54 is pivotally mounted on hinge pin 56 and the bottom of curtain 54 hangs free. Curtain 54 is either shaped or weighted so that the weight of the curtain causes the lower portion of the curtain to press against or be adjacent to the ice forming molds 46. When the evaporator defrosts and the ice falls outwardly from the ice forming molds 46, curtain 54 is pivotally moved so that its lower portion moves outward into the position as indicated in phantom and labeled by reference character 58, whereby the ice cubes are released to fall through cabinet opening 57 into the ice storage compartment 16.

Figure 3:
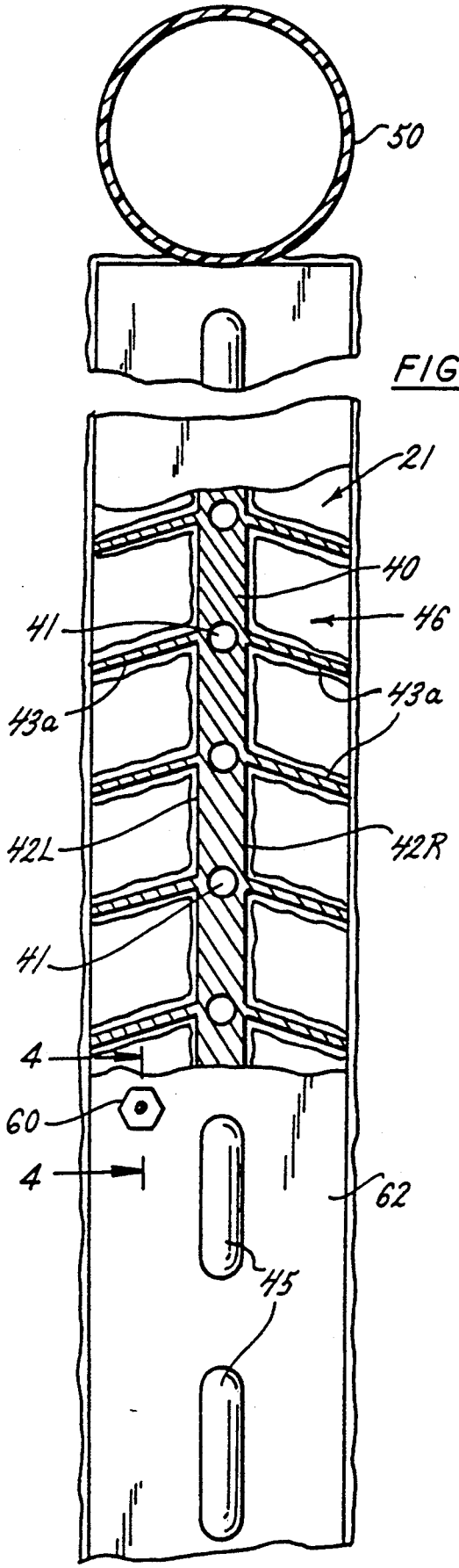
FIG. 3 is a sectional view of an evaporator section showing another form of evaporator extrusion.
Figure 4:
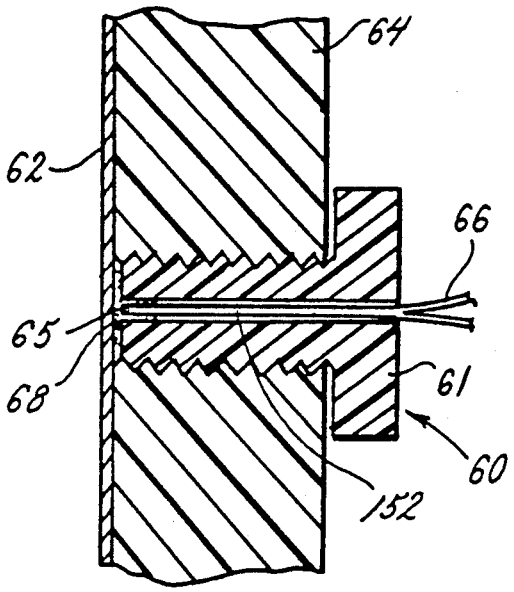
FIG. 4 is a cross-sectional view of a freeze cycle sensor taken along line 4—4 of FIG. 3.

FIGS. 3 and 4 illustrate the location of the primary temperature probe or the evaporator temperature sensor 152. In the prior art, it has been suggested that a temperature sensor should be located on the back wall of the freeze plate to sense the evaporator temperature. As noted above, a back wall sensor tends to erratically and inaccurately sense the temperature of the evaporator back wall rather than the temperature of either the evaporator or the ice temperature which relates to ice thickness. Furthermore, there is a temperature gradient across the ice mold caused by the difference between the refrigerant temperature within the evaporator and the temperature of building ice. Preferably, the sensed temperature of the ice mold should be selected to reflect the ice thickness.

According to this invention, two temperature readings are measured using temperature sensors 150 and 152. The temperature sensors may be thermistors, RTDs or thermocouples. The main sensor is the evaporator temperature sensor 152 and the other sensor is the condensing capacity (ambient) sensor 150. The evaporator sensor is fed directly into the positive side of a voltage comparator 154 (see FIG. 7 described below). The capacity sensor 152 is fed through a voltage divider circuit into the negative side of the voltage comparator circuit 154. The output of the voltage comparator circuit is directed to the input of the programmable logic array (PAL) device 156 through a filter (not shown). Basically, the ambient sensor temperature adjusts the evaporator temperature trigger point.

One feature of the present invention is embodied in the placement of temperature sensor 152 spaced away from the back wall 42 of the evaporator 21 and, consequently, away from the refrigerant passage. In particular, sensor 152 is in heat-conductive relationship with one vertical side wall 62 enclosing the evaporator 21 and lattice molds 46.

As shown in FIG. 4, it is contemplated that the outer surface of the side wall may be covered by thermal insulation 64 to enhance efficient operation of the evaporator unit 21. Positioned within the insulation 64 and in heat-conductive contact with the side wall 62 is the temperature sensor 152. The temperature sensor is preferably a thermistor unit 60 threadably mounted within the insulation 64 and having wire leads 66 projecting therefrom for connection to the control circuit described below. One feature of the present invention is the positioning of heat stabilizing material 68, such as RTV (room temperature vulcanizing) silastic, between the sensor 152 and the side wall 62. The heat sink material 68 stabilizes the thermal conductivity between the side wall 62 and the plug 61 within which the thermocouple 152 is centrally located by reducing the heat transfer rate therebetween. This prevents sudden changes in temperature, such as may result from expansion valve cycling, causing false indications. It is contemplated that the heat stabilizing material 68 may surround the tip 65 of the thermocouple 152 as well as be in contact with the side wall 62 further stabilizing heat transfer therebetween and improving the accurate detection of the temperature of the side wall 62 and ice forming condition.

Figure 5:
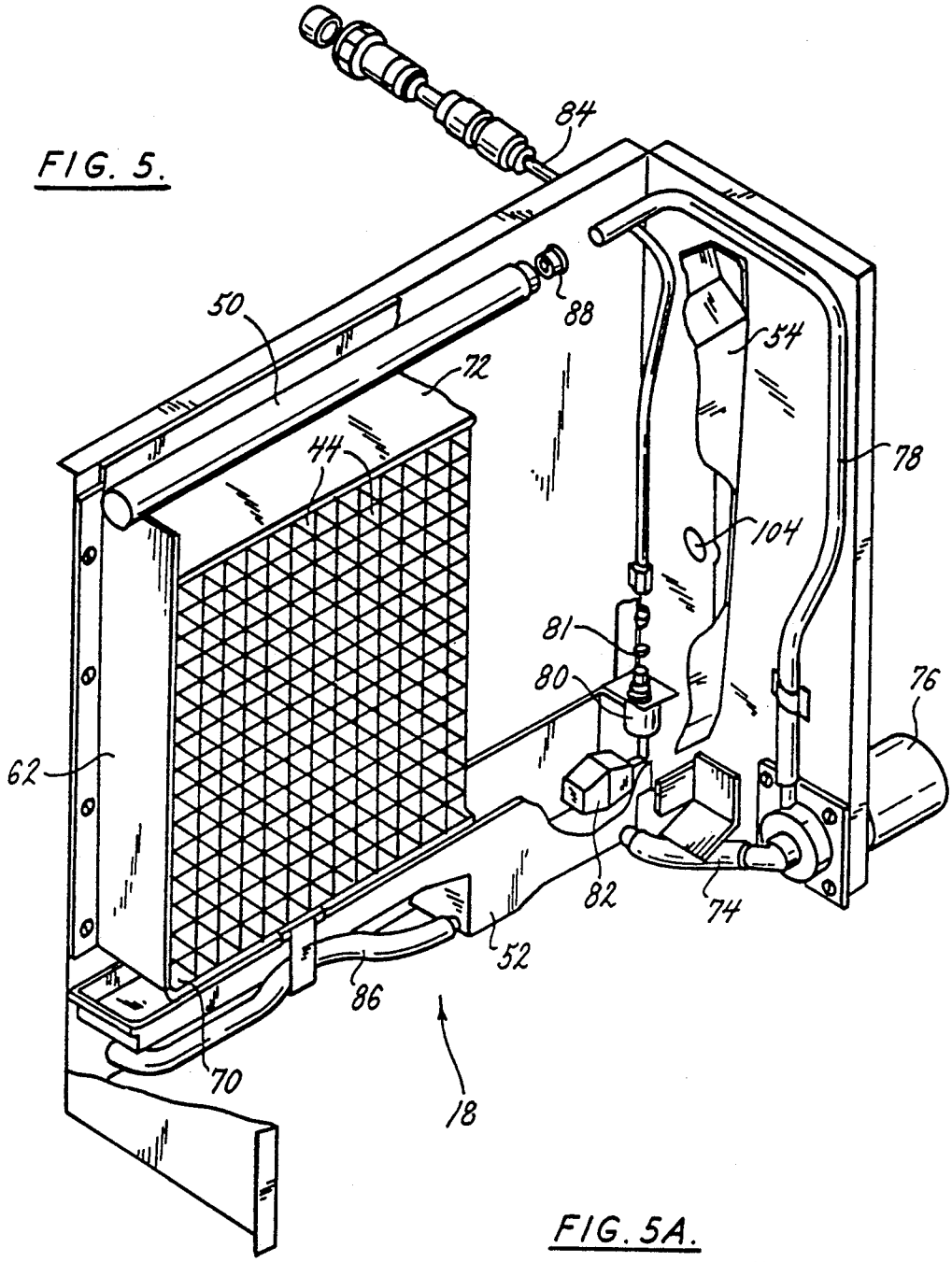
FIG. 5 is a perspective view, partly broken away, of the water supply system of the ice maker.

FIG. 5 illustrates the water supply system of the ice maker of the invention. In the FIG. 5 illustration, the evaporator is shown as having ice forming molds 46 on only one side thereof with the other side being mounted to the back wall of the water system compartment. An insulation layer may be located between the back wall and the evaporator or the back wall itself may be insulated. The evaporator mold is framed by insulated horizontal bottom wall 70, vertical side walls 62 (only one of which is shown) and horizontal top wall 72. Centered above the evaporator unit 21 within the planes defined by base surfaces 42 is distributor tube 50 which supplies water to the molds 46 by flowing water across the top plate 72 and into the molds for gravitational feeding. Transit water which is not frozen or otherwise adheres to the mold is collected in water pan 52 which is connected via supply line 74 to water pump 76. One feature of the present invention is embodied in the placement of the water pump 76. Traditionally, in the past, the water pump has been located within the refrigeration compartment 18 making the pump susceptible to freezing or changing temperature conditions. In addition, the motor and electronics were subject to the high humidity within the refrigeration chamber thereby reducing motor life. According to the present invention, only the moving, pumping portions of the water pump are located within the refrigeration compartment 18. These pumping elements are driven by a motor 96 and its associated electronics which are located outside the refrigeration compartment 18.

Water supplied from the water pan 52 via supply line 74 to the water pump 76 is pumped through feed line 78 to the distributor manifold or tube 50. The normal water level (UOL) in the water pan 52 is maintained by float valve 80 controlled by float 82. Water supply line 84 is connected to the float valve 80. A restrictor plug 88 such as a flow control washer may be located between the distributor tube 50 and the supply line 78 to control the flow of water to the distributor manifold 50.

Figure 5A:
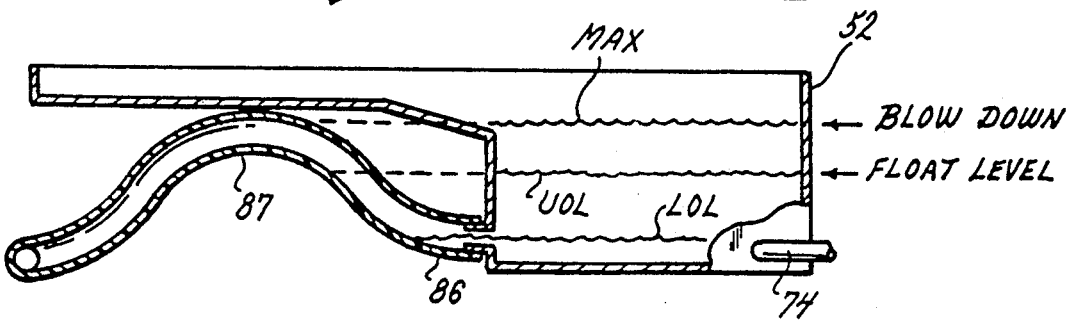
FIG. 5A is a sectional view taken along a longitudinal cross-section of the water pan and siphon hose.

In one preferred embodiment of the invention, as illustrated in FIG. 5A, siphon hose 86 includes an upwardly directed bend 87 to control periodic "blow down" or flushing of pan 52. This bend 87 is located so that water does not siphon through hose 86 during normal freeze operation as the float valve 80 maintains the upper operating levels (UOL) at a point below overflow. During ice harvesting periods in which the water pump 76 is off, water in transit in the water distributor tube 50, feed line 78, and free-falling water cascading over the evaporator 21 collects in the water pan 52. This collecting water raises the level of water in the siphon loop 87 and pan 52 to a maximum level (MAX), and the float valve 80 shuts off the water supply above the UOL level thereof. When the MAX level is above loop 87, a siphoning action is begun to discharge the mineral rich water in pan 52 through the hose and out to drain off the bottom of the pan 52. As the water level drops below the UOL level during the siphoning action, the float valve opens to deliver fresh water to help flush the pan 52. When the water reaches the lower operating level (LOL), the siphon action becomes inoperative because the LOL is below the inlet of hose 86 causing air to enter hose 86 and break the siphoning action. During freeze periods in which the pump 76 is operating, the water level is approximately maintained at the upper operating level (UOL) by the float valve 80. In prior art water systems, a constant regulating valve was required to admit water at a lower rate than that of the siphoning action to prevent continuous blow-down.

Figure 6:
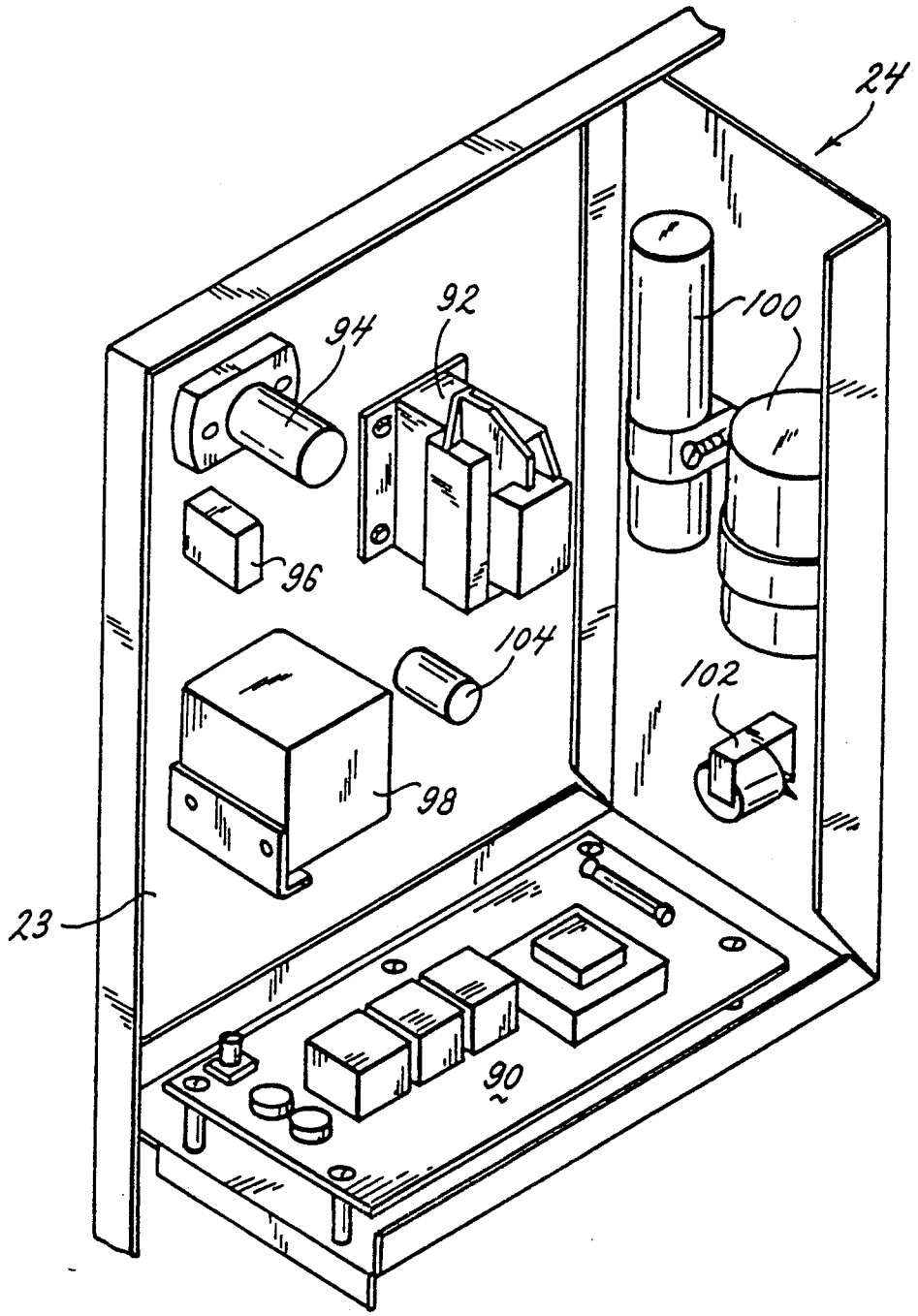
FIG. 6 is a perspective view of the control circuit compartment and harvest proximity control for the ice maker.
Figure 7:
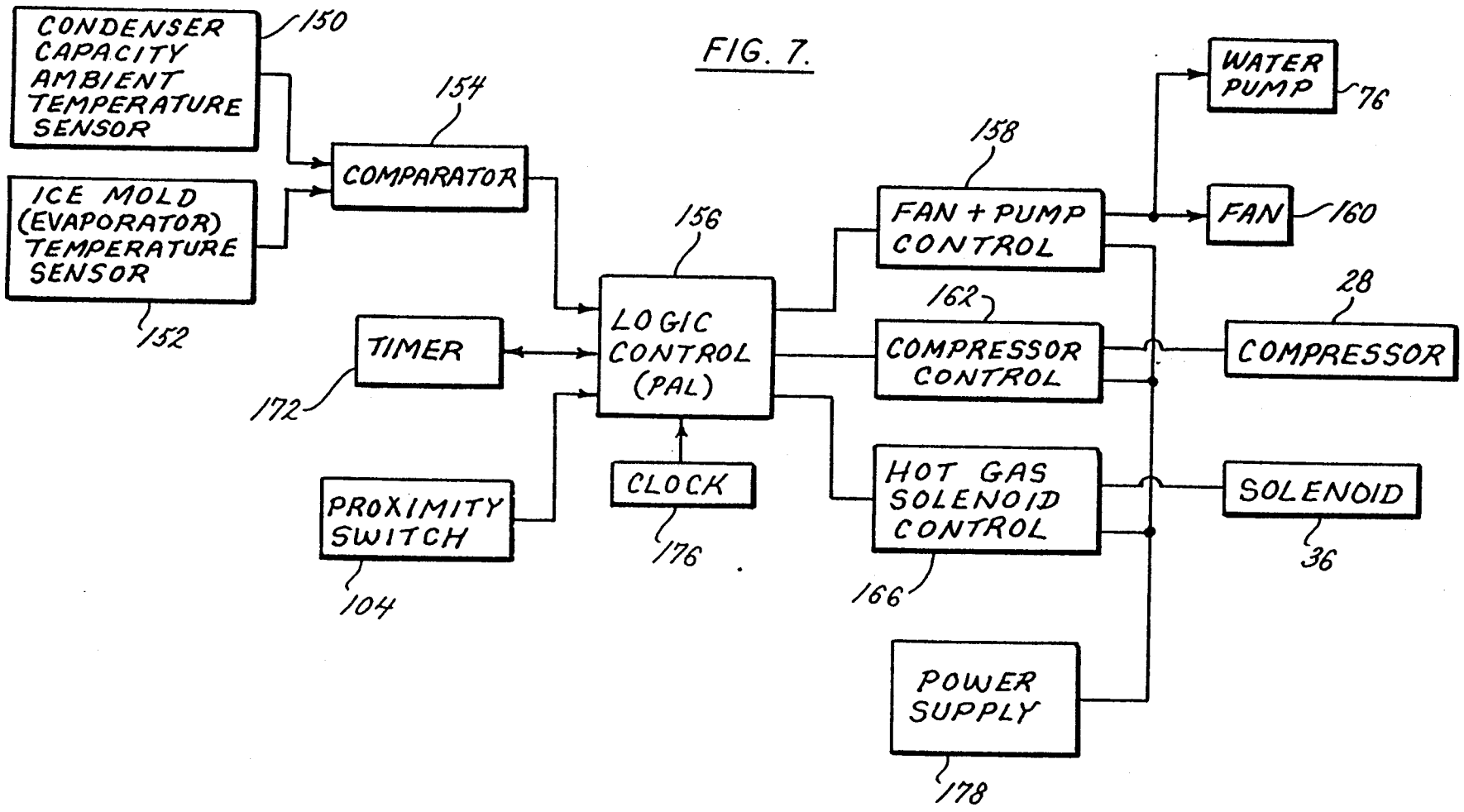
FIG. 7 is a block diagram of the control circuit of the ice maker.

FIG. 6 illustrates the control circuit compartment 26. The components of the control circuit, as illustrated in FIGS. 7 and 9 and described below, are generally positioned within this compartment. Circuit board 90 is mounted within the compartment 26 and supports various components which are directly mounted to it. Also within the compartment 26 are the other electrical components of the ice making apparatus. For example, contactors 92 which control operation of the compressor 28, as described below, may be mounted on the side wall 23 of the compartment. Also positioned on the side wall are high pressure cut-out 94, on/off switch 96, and start relay 98 for initially supplying power to the compressor. Positioned on and mounted to the back wall are capacitors 100 and safety thermostat 102.

One feature of the present invention is embodied in the use of magnetic proximity switch 104 for detecting the position of curtain door 52. As illustrated in FIGS. 1, 2, 5 and 6, the proximity switch is preferably located on the side wall 23 of the control compartment 26. However, it is contemplated that the proximity switch 104 may be located in any position near the door 54 so that the position and movement of the door may be detected. For clarity much of the electrical wiring which interconnects these components has not been illustrated. Suitable wiring is provided between the components as will be understood by those in the art.

The location of the proximity switch 104 is best illustrated in FIG. 5, and the operation of switch 104 to detect the movement of door 54 is best illustrated in FIG. 2. Curtain door 54 includes a target 106 which affects the magnetic field of and is detectable by proximity switch 104. During the ice making cycle, curtain 54 remains closed so that the target 106 is adjacent to or near proximity switch 104 to close and provides a signal to initiate or maintain a freeze cycle. During the defrost cycle when ice falls away from the ice molds 46, door 54 is moved to position 58 so that target 106 swings outwardly away from the proximity switch 104 thereby disturbing the magnetic field and opening the switch to provide an indication that the ice is being harvested from the mold and that the door is open. When the ice completely falls away from the mold and is discharged into the lower bin 16, the weight of door 54 causes the door to close against the mold thereby repositioning the magnetic target 106 adjacent proximity switch 104 so that the switch 104 closes and again provides an indication that the next ice making cycle may begin. In the event that the ice compartment 16 is full, harvested ice which falls away from the mold will not drop and will be held in place between the door 54 and the ice mold preventing door 54 from reclosing. This prevents magnetic target 106 from again being repositioned adjacent proximity switch 104. Without this repositioning occurring, no signal is provided to begin the next ice forming cycle.

FIG. 7 is a block diagram of an ice cube maker controller according to the invention. Preferably, ambient temperature sensor 150 senses the liquid line temperature (or pressure) of the condenser 30. This temperature relates to the condenser capacity and efficiency. For example, the refrigerant temperature on the output side of the condenser 30 may be sensed and, preferably, ambient temperature sensor 150 senses the condensing capacity by measuring the temperature of the liquid line 31 to the evaporator unit 21. Alternatively, ambient air temperature or some other temperature or pressure which is related to or proportional to the ambient temperature of the ice maker may be sensed. As previously described, the primary evaporator temperature sensor 152 senses the effective temperature of the ice mold of evaporator 21 as ice builds up during the freeze cycle of the ice maker. In general, this sensor 152 is in direct contact with some extended portion of the evaporator, such as one side wall panel 62 framing the lattice molds 46.

Figure 8:
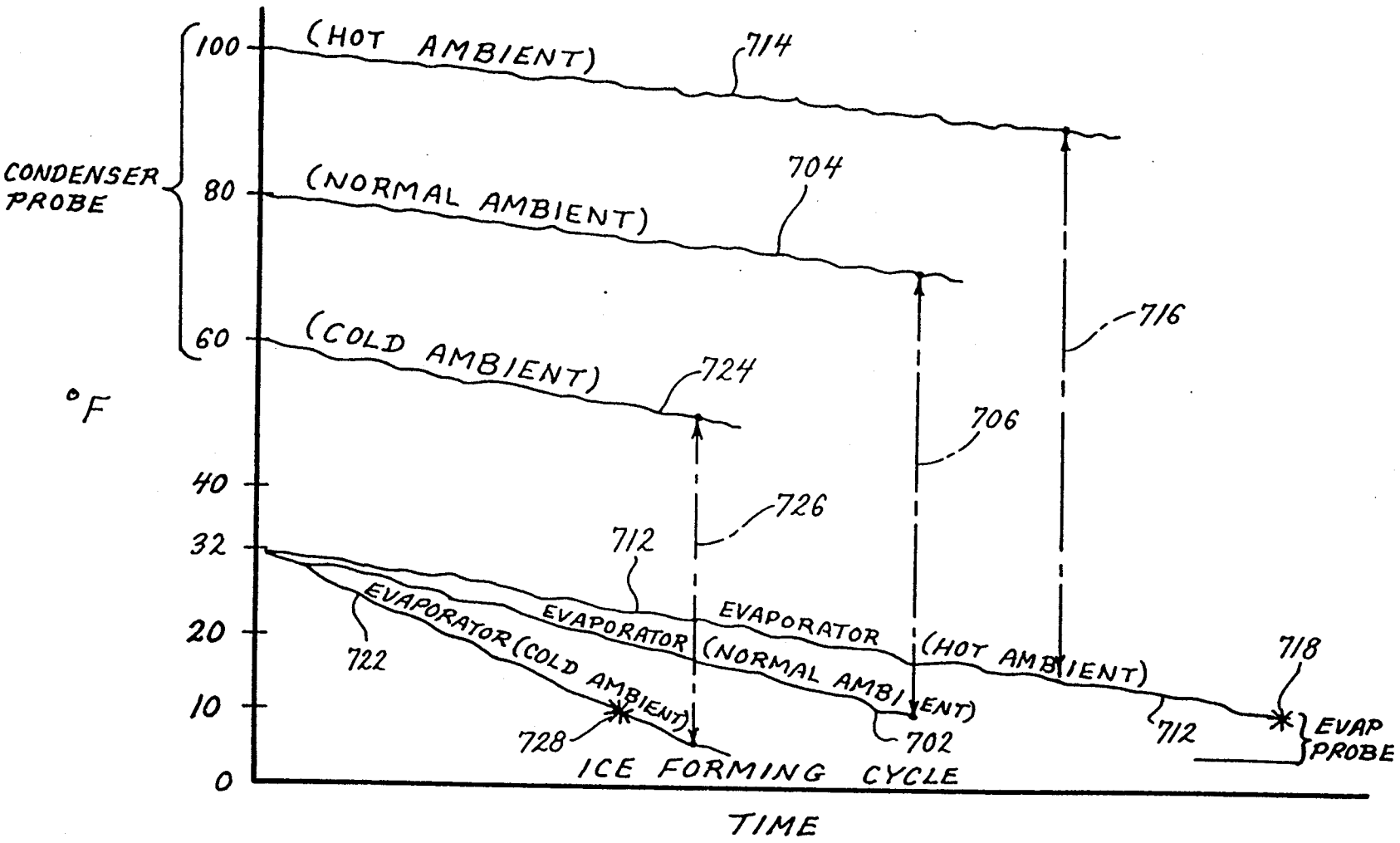
FIG. 8 is a time/temperature graph showing ambient and evaporator temperatures during freeze and harvest cycles at different seasons.

The condenser capacity temperature representing ambient and the ice mold temperature are compared by comparator 154. As ice begins to build on the ice forming molds 46 in contact with the evaporator 21, the difference between the ambient temperature and the ice mold temperature will tend to increase as shown in the graph of FIG. 8. In particular, reference character 702 indicates the evaporator temperature during a normal range of ambient temperatures and saturated refrigerant conditions. As the evaporator continues to operate during the ice forming cycle, the sensed temperature of the evaporator decreases, i.e., the temperature of the ice mold decreases as ice forms. In general, for certain embodiments, the design condensing temperature tends to be about 20° F. above the normal ambient temperature. As a result, the temperature at the high side of the condenser, i.e., the temperature of the subcooled liquid, tends to be about 10° F. below the condensing temperature.

For example, at the beginning of the ice making cycle, the ice mold may be about 32 degrees Fahrenheit, the temperature of the water flowing over the ice molding surfaces. As the water freezes, the mold temperature decreases substantially and quickly. In contrast, reference character 704 indicates that the condenser output or liquid line temperature decreases slightly and slowly during the ice forming cycle. In other words, the evaporator temperature decreases at a faster rater than the liquid line temperature. When the difference 706 between the evaporator temperature 702 and the normal condensing temperature 704 reaches a predetermined value, the ice forming cycle is terminated and the harvest cycle begins. Specifically, when that difference reaches a certain preset level, comparator 154 provides an indication to logic control 156 that this preset temperature difference has been reached. In fact, the evaporator temperature trip point which initiates the harvest cycle is adjusted according to condenser capacity. In this way, the ice making cycle length is adjusted to take into account ambient air temperature being forced through the condenser and the operating efficiency of the condenser. A clogged or dirty condenser or a refrigerant shortage, which would tend to reduce condenser efficiency, would be taken into account in determining the length of the ice making cycle and the point at which ice harvesting should occur.

In the situation when the ambient temperature is above normal, referred to as "hot ambient" herein, the ice maker 10 of the invention operates in the following manner. In particular, reference character 712 indicates the evaporator temperature during hot ambient conditions. As the evaporator 21 continues to operate during the ice forming cycle, the temperature of the evaporator decreases, but a slower rate than the rate of decrease during normal ambient temperatures. Reference character 714 indicates the hot ambient temperature, e.g. the condenser output temperature, which remains substantially constant during the ice forming cycle. When the difference between the evaporator temperature 712 and the normal ambient temperature 714 reaches preset value 716, the ice forming cycle is terminated and the harvest cycle begins. In the FIG. 8 illustration, a typical ice forming cycle during hot ambient is longer than the ice forming cycle during normal ambient because of the less efficient operation of the condenser in a hot ambient environment, and would terminate at point 718 resulting in oversized ice cubes. However, the ice forming cycle during hot ambient according to the preferred form of the invention is appreciably shorter than such a typical ice forming cycle resulting from sensing only the evaporator temperature, and the ice cubes produced are substantially the same size as during normal ambient conditions and within a comparable freeze time.

In the situation when the ambient temperature is below normal, referred to as "cold ambient" herein, the ice maker of the invention operates in the following manner. In particular, reference character 722 indicates the evaporator temperature during cold ambient conditions. As the evaporator 21 continues to operate during the ice freeze cycle, the temperature of the evaporator at a faster rate than the rate of decrease during normal ambient temperatures. Reference character 724 indicates the cold ambient temperature resulting in subcooled liquid line temperature, which remains substantially constant during the ice freeze cycle. When the difference between the evaporator temperature 722 and the normal ambient temperature 724 reaches preset amount 726, the ice forming cycle is terminated and the harvest cycle begins. In the FIG. 8 illustration, a typical ice forming cycle during cold ambient is shorter than the ice forming cycle during normal ambient because of the more efficient operation of the condenser in a cold ambient environment and would be terminated at point 728 resulting in undersized ice cubes. However, the ice forming cycle during cold ambient according to the invention is appreciably longer than such a typical ice forming cycle resulting from sensing only the evaporator temperature, and the ice cubes produced are substantially the same size as during normal ambient conditions and within a comparable freeze time.

Referring again to FIG. 7, logic control 156 initiates the ice making cycle by actuating the fan control 158 and the compressor control 162 and maintaining their operation. Fan and pump control 158 controls the operation of fan 160 to cool the condenser 30 and the water pump 76 pumping water over the ice mold. Compressor control 162 controls the operation of the compressor 28 to compress the fluid being circulated within the refrigeration system 19. When comparator 154 indicates that the preset temperature difference has been reached, logic control 156 initiates the harvest cycle by deenergizing fan 160 and pump 76 and by energizing solenoid 36 to apply hot gas to the evaporator unit 21. The harvest cycle includes a defrost period followed by a delay period. To initiate the harvest cycle, logic control 156 actuates the hot gas solenoid control 166 which energizes solenoid 36. Solenoid 36 in turn connects the evaporator 21 to the compressor discharge line 29 to supply superheated refrigerant gas to heat the evaporator 21 and its associated ice forming molds 46 so that ice formed during the freeze cycle will slide out of the ice forming molds.

As the defrost cycle continues, ice eventually falls away from the ice forming molds 46 moving the curtain wall outwardly to an open position 58 shown in phantom lines in FIG. 2. This movement is detected by proximity switch 104 which provides an indication to logic control 156 that the curtain has moved away to release the ice cubes to fall by gravity into the lower ice compartment 16. This causes logic control 156 to terminate the defrosting cycle and then reset to initiate another ice making cycle.

Logic control 156 may be associated with a timer 72 which provides an adjustable delay period, such as seven seconds, from the time that the proximity switch 104 opens to indicate that the curtain 54 has moved away from the ice forming mold until the curtain moves back into position next to the ice forming molds. After, the harvest cycle is not terminated, the next ice freeze cycle is not initiated until the detection by the proximity switch that the door has reclosed. When the bin 16 is full, ice holds the curtain door 54 open to prevent reclosing of the door and initiation of the next ice making cycle. Removal of ice from the bin will close the curtain door reactivating the ice making process. In the event that the door does not reclose within the delay period, logic control 156 deactivates fan and pump control 158 and compressor control 162 to turn off the ice maker and discontinue operation until the door closes.

Logic control 156 is also associated with clock 74 which times the operation of the logic control. Fan and pump control 158, compressor control 62 and hot gas solenoid control 166 are connected to power supply 176 which supplies power to these controls and to fan 160, water pump 76, compressor 28 and solenoid 36 in response to these controls.

FIG. 9 is a schematic diagram of the ice maker controller of FIG. 7. Thermistor 502 connected to pins 1 and 2 of terminal block 504 functions as ambient temperature sensor 150. Thermistor 502 has an ambient resistance, such as 13K or 19K ohms, which varies according to sensed temperature. This resistance is in series with variable resistors RA1 and RA2 which are part of a voltage divider with resistor R4. As a result the voltage applied to the inverting input of comparator 506 varies according to the temperature being sensed by thermistor 502. As illustrated, a +5-volt signal is applied to the voltage divider via resistor R4. Variable resistors RA1 and RA2 are adjusted to set a level corresponding to a coarse adjustment of ice thickness.

Thermistor 508 is connected to pins 3 and 4 of terminal block 504 and senses the evaporator temperature 152. Thermistor 508 has an ambient resistance, such as 10K ohms, which varies according to sensed temperature. A +5-volt signal is divided by resistor R3 and the resistance of thermistor 508, as filtered by capacitor C1, and applied to the noninverting input of comparator 506. The noninverting input is also connected to a hysteresis loop formed by resistor R20 connected to the output of comparator 506. A 5-volt signal filtered by capacitor C13 provides power to comparator 506. A manual harvest switch SW1 may be provided to ground the inverting input of comparator 506 thereby causing comparator 506 to trip and begin a manually initiated harvest cycle. As the ice making cycle continues, the evaporation temperature tends to decrease and the ambient temperature tends to remain substantially constant (see FIG. 8). When the difference between these temperatures reaches a preset amount, determined in part by adjusting the resistance of resistors RA1 and RA2, comparator 506 is tripped to actuate Schmidt trigger 510. For example, comparator 506 may be tripped when the voltage applied to its noninverting input (corresponding to the evaporator temperature) becomes less than the voltage applied to the inverting input (corresponding to the ambient temperature). Schmidt trigger 510 provides an output signal through filter R19, C12 to another Schmidt trigger 512 which provides a signal to logic control 56 in the form of a programmable array logic (PAL) 514. The Schmidt triggers stablize the output of comparator 506 to prevent false triggering of PAL 514. The output of Schmidt trigger 512 is supplied to input I2 of PAL 514. This changes the state of the PAL to initiate the harvest cycle.

PAL 514 is programmed to provide output signals via outputs O3 and O4 during the ice making cycle. Output O3 is connected via resistor R11 to transistor switch Q2 which illuminates green LED 516 and energizes relay RL1. This in turn closes contacts 518 so that power is applied to the condenser fan and the water pump. Filter R10, C8 may be connected between the contacts to prevent sparking and surging.

Similarly, output O4 is connected to the base of transistor switch Q3 via resistor R13 to turn the switch on thereby illuminating green LED 520. This results in relay RL2 being energized to close contacts 522. As a result, power is applied to the compressor (COMP). Once again, filter R12, C9 may be located between the contacts.

When an input signal is provided to input I2 of PAL 514 by Schmidt trigger 512, outputs O3 and O5 change state. Output O3 goes low to open switch Q2 and turn off the fan and pump. Output O5 goes high to close switch Q4 via resistor R15 thereby illuminating the red LED 524 and energizing relay RL3. This closes contacts 526 to apply power to the defrost solenoid (DEF SOL). Filter R14, C10 may bridge contacts 526. Actuating the solenoid results in defrosting of the evaporator such as by applying hot gas thereto. The defrosting of the evaporator continues until ice falls away from the ice forming mold causing the curtain to be moved away from the ice mold. This movement of the curtain is detected by proximity switch 104 which is connected to terminals 5, 6 and 7 of the terminal block 504. Terminal 7 provides +17 volts of power to proximity switch 104. The output of proximity switch 104 is provided to input I1 of PAL 514 indicating that the curtain has been moved away from the ice mold by falling ice. This changes the state of the PAL and terminates the defrost cycle by terminating the signal at output O5 and by providing a low output signal to output 08. This change deenergizes the solenoid and terminate hot gas application to the evaporator. In addition, output 08, which is normally high, goes low to turn off switch Q1 via resistor R9 and begin the charging of capacitor C6 via resistor R8 by a +5 volt supply. If proximity switch 104 closes before capacitor C6 is charged, input I1 returns to its initial state to initiate the logic of PAL 514 to begin the next ice making cycle. This results in a signal again being provided by output O2 to actuate the fan, water pump and a continuing signal being provided by output O3 to continue operating the compressor. No signal is provided by output O4 so that the solenoid is deenergized and closed.

When the curtain moves away from the ice forming mold, the proximity switch opens so that the voltage level applied to the noninverting input of comparator 534 goes low providing a signal to input I1 of PAL 514. This causes output O5 of PAL 514 to go low and output 08 of PAL 514 to go high which turns on switch Q1 to charge capacitor C6 by the +5 volts being applied via resistor R8 and actuate a timer. The period timed by the timer is determined by the time required to charge capacitor C6 via transistor switch Q1. If the door does not close within the preset delay period, indicating that the bin is full, the charge on capacitor C6 increases to a point that the noninverting input of comparator 528 goes higher than the inverting input. This causes inverter 528 to provide a cutoff signal to input I3 of PAL 514 to deenergize all logic outputs O3, O4, and O5 to turn the machine off. Resistor R16 forms a hysteresis loop on comparator 528 to prevent premature tripping. The machine remains off until the door closes to close the proximity switch 104 thereby initiating the PAL 514 logic and beginning the next ice cycle.

Schmidt triggers 540 and 542 provide an oscillating input to Schmidt trigger 544, e.g., 100 hertz, which provides a clock signal to CLK input of the PAL 514 to time the logic of the PAL 514. Transformer TD1 steps down the 120 VAC power applied to the fan, water pump, compressor and defrost solenoid to +17 volts which is applied to voltage generator 546 to generate a +5-volt signal. Both the +17 and +5-volt signals are used throughout the controller circuit, as indicated. Comparator 548 initializes the PAL and prevents its operation during unstable voltage conditions. Comparator 548 does not initialize the PAL unless capacitor C5 is charged thereby preventing operation is the power is fluctuating.

Figure 10:
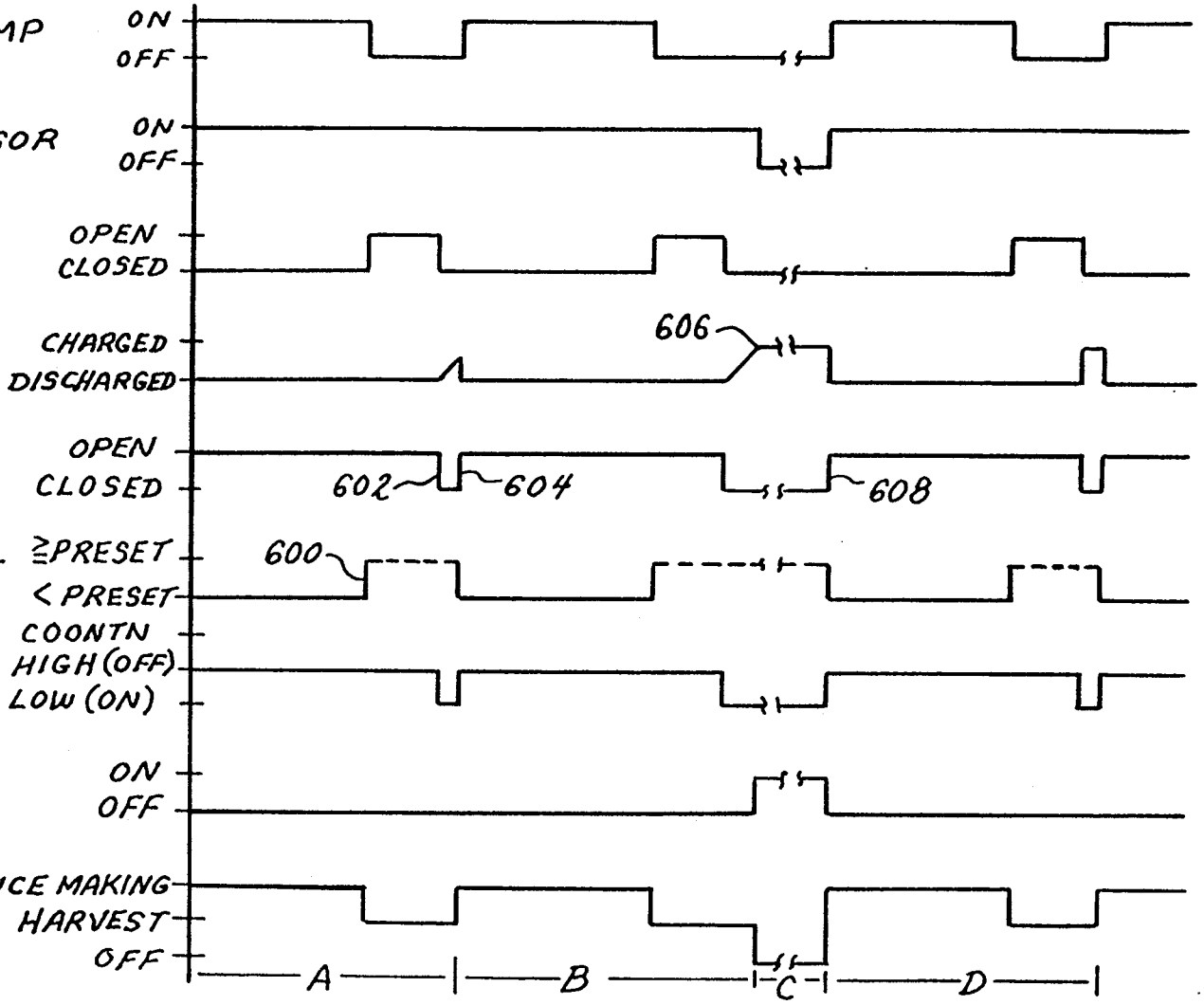
FIG. 10 is a timing diagram illustration operation of the ice making machine according to the invention.

FIG. 10 is a timing diagram of the various cycles of the machine according to the invention. During period A, the machine proceeds through an ice making cycle and a harvest cycle. When the preset temperature difference is reached at time 600, the fan and pump go off and the solenoid is opened to begin the harvest cycle. As the ice slides away from the mold, it moves the curtain to an open position at time 602. This is sensed by the magnetic proximity switch which is opened to cause the solenoid to close and the timer output O8 to go low thereby beginning the charging of the capacitor C6. When the curtain closes after the ice drops away, at point 604, the next ice making cycle is initiated. During the harvesting cycle within period B, the curtain fails to close within the period timed by the timer so that the capacitor becomes fully charged at point 606, causing the machine to enter an off cycle. During period C, the machine is not generating ice. At point 608, the curtain closes indicating that ice has cleared the mold and the next ice making cycle is initiated. Period D begins with this next ice making cycle, continues with a harvest cycle and ends with the beginning of the next ice making cycle.

In one alternative form of the invention, a single sensor is positioned within a plastic bottom molding on the evaporator beneath the center of an ice pocket.

A preferred ice maker includes an evaporator and an ice former attached to the evaporator. A cooler includes a compressor, a condenser and an expansion valve connected to the evaporator to cool the evaporator and to freeze water on the ice former. A defroster is connected to the evaporator to harvest ice from the ice former in a harvest cycle. A sensor is connected to a bottom molding on the evaporator for sensing temperature of the molding and water flowing over the suface of the molding. A controller is connected to the sensor and to the cooler for controlling the cooler in response to sensed temperature.

Preferably the molding comprises a plastic molding along a bottom of the ice former.

The preferred evaporator includes plural ice cube pockets, and the sensor is preferably positioned in the bottom molding below a center of a lower ice-forming pocket.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

Figure 11:
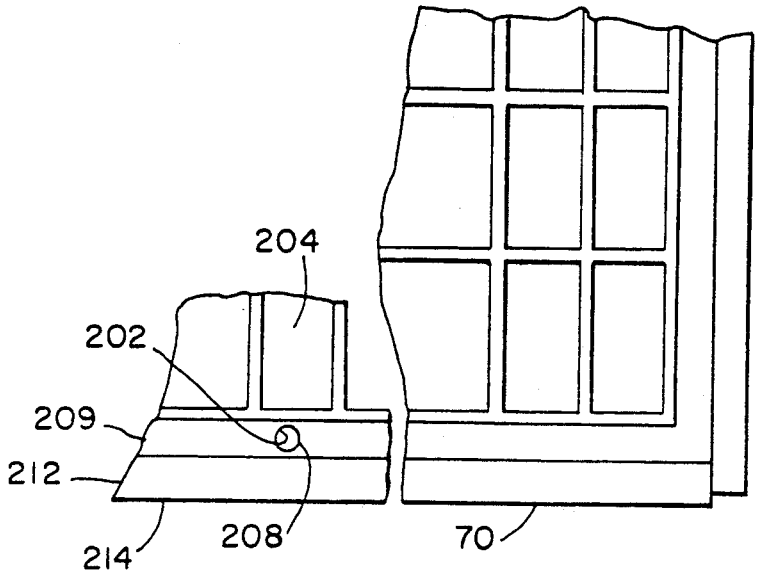
FIG. 11 is a partial front elevation of an ice former showing the bottom plastic molding and a bottom mount sensor.

As shown in FIGS. 5 and 11, the bottom insulated wall 70 is a plastic molding on the bottom of the ice formers.

One preferred temperature sensor 200 that may be used alone is located in a ⅛" diameter hole 202 drilled transversely through the bottom plastic molding 70 approximately 5" from the right side of the ice former. The hole 202 is located beneath the approximate center of ice cube pocket 204. The hole is enlarged horizontally where it exits, until a thermistor 206 can be inserted through the rear of the molding 70.

Figure 9A:
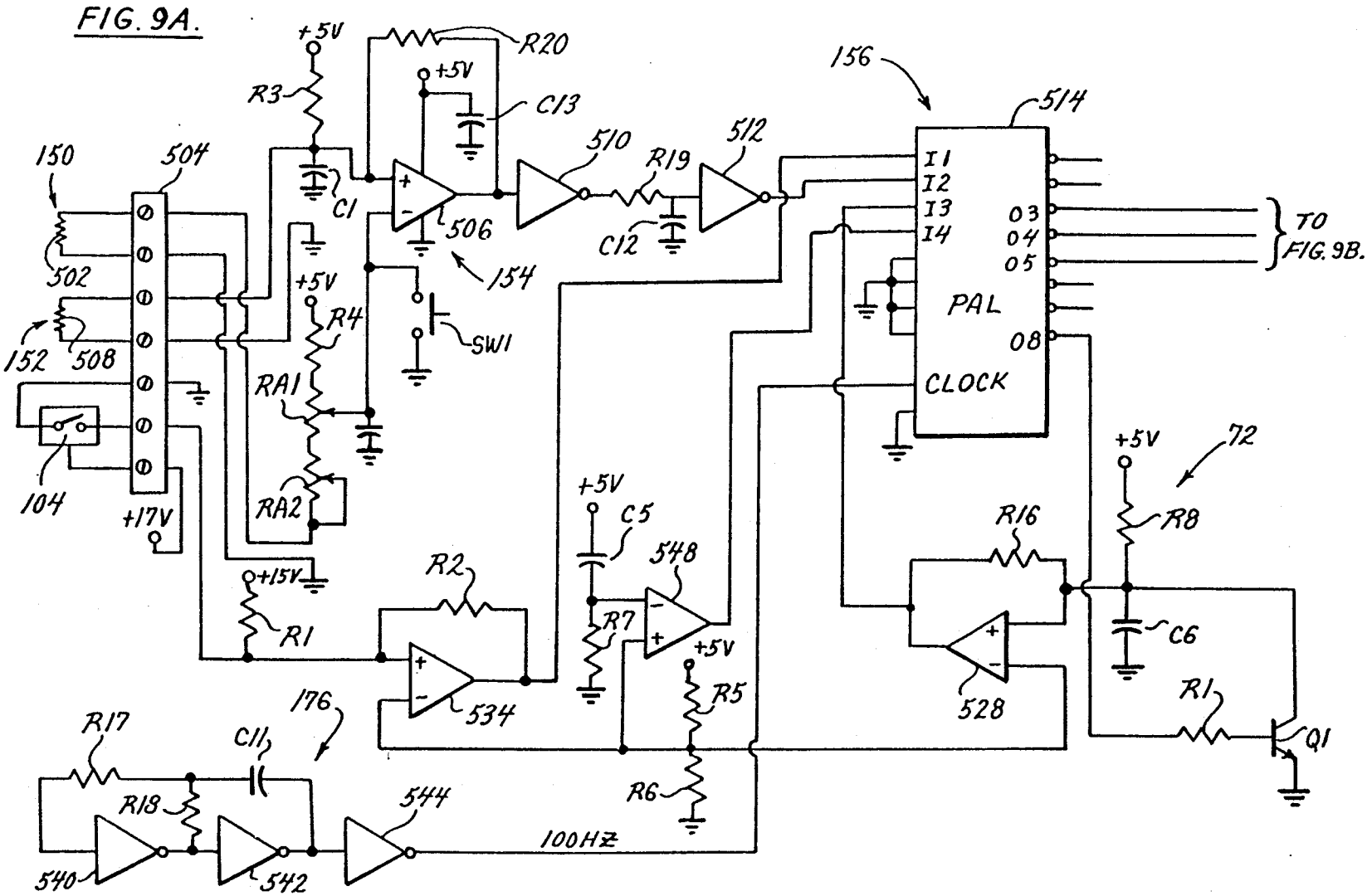
FIG. 9 is a schematic diagram of the control circuit for the ice maker.
Figure 9B:
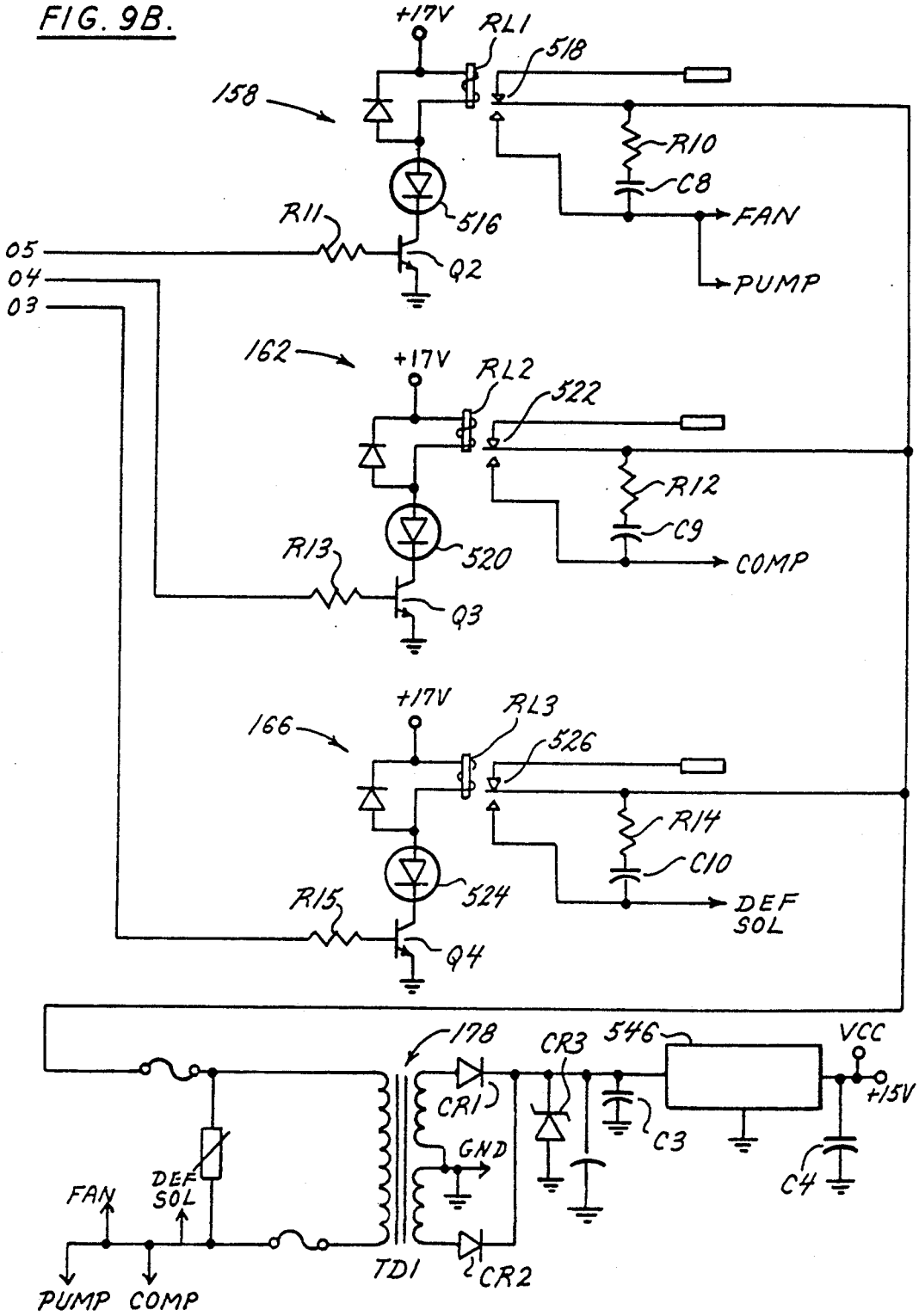

To use the thermistor 206 with the circuit shown in FIG. 9A, thermistor 502 is replaced by a jumper wire connected across pins 1 and 2 in circuit board 504. That effectively grounds the adjustable contact on adjustable resistor RA2.

The bottom mounted thermistor 206 is connected to pins 3 and 4 of the circuit board in place of the thermistor 508 shown in FIG. 9A. Preferably thermistor 206 is passed down and under the evaporator side molding and is inserted in the back of hole 202 drilled through the bottom molding 70. Tip 208 of thermistor 206 is flush with or slightly exposed from the front surface 209 of the molding. Thermistor 206 is sealed to the molding at both entry and exit points with silicone adhesive 210.

During the chilling and warming of the ice former, temperature variations in the bottom molding tend to lag temperature variations in the ice former. Heat is taken up by the ice former and the evaporator, first chilling the water and then solidifying the water into ice. A large amount of heat taken up by the evaporator, or in the opposite sense cold delivered to the water, is in the form of heat of transformation by changing the state of the water from a liquid to a solid.

The heat transfer is conducted from the vertical base and the partition walls of the ice former pockets to water which is slowly cascaded over the ice former, and then as ice forms in the pocket, through the ice to water which is slowly cascaded over the forming ice as the heat is transferred from the water through the ice to the copper pan or vertical base and to the evaporator, the temperature differential is mostly consumed in the transformation from water to ice. As the ice fills the pockets, less heat of transformation is taken up, and the copper pan or ice former becomes colder.

The centering of the thermistor 206 beneath the center of an ice pocket reduces the effects of localized chilling which would occur if the thermistor were placed closer to the one end or to one of the vertical partitions.

Figure 12:
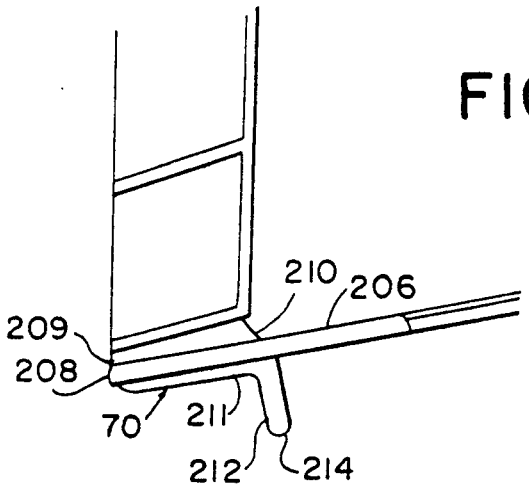
FIG. 12 is a partial side elevational cross-section of the ice former, plastic molding and sensor shown in FIG. 11.
Figure 13:
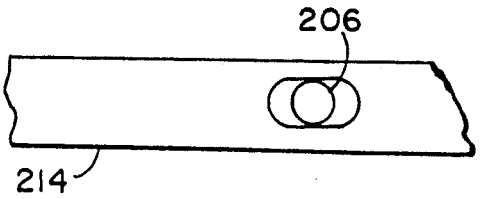
FIG. 13 is a detail of a rear elevation of the plastic molding and sensor shown in FIGS. 11 and 12.

As shown in FIGS. 12 and 13, the bottom plastic molding 70 has a curved front surface 209, an upward and rear sloping bottom surface 211, and a rearward leg 212. The water which is slowly cascaded over the ice former flows along the surface of the plastic molding and falls from the tip 214 into the collection pan.

The plastic molding 70 is made of polyvinyl chloride or other suitable food contact plastic. The purpose of the molding is to prevent the formation of ice from the water which flows around the molding. That is accomplished because the plastic is a thermal insulator with relatively poor thermal conductivity. The bottom plastic molding prevents water from flowing rearward and forming ice along the cold lower surface of the ice former, which would render defrosting and ice harvesting difficult. Since the plastic remains at a higher temperature than the ice former, due to the insulating qualities of the plastic, the surfaces of the plastic molding along which water flows remain at the temperature of the water, and no ice is formed. As the ice pockets fill, excess water leaving the ice former and starting its flow over the bottom plastic molding 70 is at freezing temperature. A small amount of water covers the tip of the thermistor, which is exposed at the front opening. The covering of the tip of the thermistor with a coat or partial coat of ice allows the temperature of the thermistor tip to drop below the flowing water temperature and approach the internal temperature of the plastic molding. That signals that the ice pockets are full and that the harvesting cycle is ready to begin.

The bottom mounted thermistor or other suitable temperature sensor, such as a thermocouple, may be positioned at any place along the bottom plastic molding. While it is preferred to center the thermistor beneath a center of an ice pocket and to inset the thermistor from the edge of the ice former, suitable results may be obtained with any position of the bottom mounted sensor.

FIGS. 11 and 12 show the bottom plastic molding mounted along the lower edge of a copper pan and attached evaporator tubing. Similar plastic molding is used along the bottom of an integral evaporator and ice former, as shown in the other drawings, for example FIG. 5. The bottom plastic molding and the bottom mount thermistor is useful in any similar type of ice maker.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. An ice maker comprising an evaporator, an ice former attached to the evaporator, a cooler including a compressor, a condenser and an expansion valve connected to the evaporator to cool the evaporator and to freeze water in the ice former, a defroster connected to the evaporator to harvest ice from the ice former in a harvest cycle, means for flowing water over the ice former and over a bottom molding on the evaporator a sensor connected to the bottom molding for sensing temperature of the molding and of water flowing over the molding, and a controller connected to the sensor and to the cooler for controlling the cooler in response to sensed temperature of the water and in the molding.

2. The ice maker of claim 1, wherein the molding comprises a plastic molding along a bottom of the ice former.

3. The ice maker of claim 2, wherein the evaporator includes plural ice cube pockets, and wherein the sensor is positioned in the bottom molding below a center of a lower ice-forming pocket.

4. In the method of controlling a freezing cycle in ice making, comprising chilling an ice former having cube pockets, flowing water downward over surfaces of the cube pockets and into the cube pockets, and flowing water out of the ice former downward around a bottom plastic molding, and releasing water from the molding into a water collector for recycling to the top of the ice former, the improvement comprising positioning a temperature sensor in the bottom plastic molding and sensing temperature of flowing water leaving the ice former and flowing across the temperature sensor, and sensing temperature change when ice covers at least a portion of the sensor, and thereupon stopping the ice forming cycle and beginning the ice harvesting cycle.

* * * * *